US009936814B2

(12) United States Patent
Alder et al.

(10) Patent No.: US 9,936,814 B2
(45) Date of Patent: Apr. 10, 2018

(54) INFLATABLE PAD AND METHODS FOR USING THE SAME

(71) Applicant: Argon Technologies, Inc., Ogden, UT (US)

(72) Inventors: Robert N. Alder, North Ogden, UT (US); Cory S. Tholl, Kaysville, UT (US); Matthew Maxfield, North Salt Lake, UT (US)

(73) Assignee: ARGON TECHNOLOGIES, INC., Ogden, UT (US)

( * ) Notice: Subject to any disclaimer, the term of this patent is extended or adjusted under 35 U.S.C. 154(b) by 0 days.

(21) Appl. No.: 15/601,869

(22) Filed: May 22, 2017

(65) Prior Publication Data

US 2017/0251822 A1 Sep. 7, 2017

Related U.S. Application Data

(63) Continuation of application No. 14/860,451, filed on Sep. 21, 2015, now Pat. No. 9,756,955, which is a continuation of application No. 12/942,897, filed on Nov. 9, 2010, now abandoned.

(60) Provisional application No. 61/259,568, filed on Nov. 9, 2009, provisional application No. 61/370,405, filed on Aug. 3, 2010.

(51) Int. Cl.
*A47C 27/08* (2006.01)

(52) U.S. Cl.
CPC ..... *A47C 27/081* (2013.01); *A47C 27/087* (2013.01)

(58) Field of Classification Search
CPC ..... A47C 27/081; A47C 27/10; A47C 27/18; A47C 27/08; A47C 27/128; A61G 7/05769; A61G 7/05776
See application file for complete search history.

(56) References Cited

U.S. PATENT DOCUMENTS

| | | | | | |
|---|---|---|---|---|---|
| 1,351,480 | A | * | 8/1920 | Leigh | A47C 27/081 5/706 |
| 2,842,783 | A | * | 7/1958 | Druck | A47C 27/081 297/DIG. 3 |
| 3,235,892 | A | * | 2/1966 | Emery | A47C 15/006 441/130 |
| 3,253,861 | A | * | 5/1966 | Howard | A47C 7/021 297/229 |
| 3,872,525 | A | * | 3/1975 | Lea | A47C 27/084 5/671 |
| 4,428,087 | A | * | 1/1984 | Horn | A47C 27/081 5/638 |
| 4,688,283 | A | * | 8/1987 | Jacobson | A47C 27/081 5/709 |
| 4,777,679 | A | * | 10/1988 | DeLooper | A61G 7/05776 5/655.3 |
| 5,604,945 | A | * | 2/1997 | Fisher | A47C 27/10 441/129 |

(Continued)

*Primary Examiner* — Eric J Kurrila
(74) *Attorney, Agent, or Firm* — Durham Jones & Pinegar, P.C.

(57) ABSTRACT

The inflatable pad includes an inflatable frame having a length and width that defines a pad area suitable for supporting a person lying thereon. A plurality of internal support members are configured to support the weight of a person lying thereon and elevate the person above the ground. The inflatable pad includes non-supporting regions that require less fill volume than regions that support primary support regions such as the hips and shoulder.

20 Claims, 6 Drawing Sheets

(56) References Cited

U.S. PATENT DOCUMENTS

| | | | | | |
|---|---|---|---|---|---|
| 5,679,040 | A | * | 10/1997 | Bianchi-Holm | A47C 20/00 441/129 |
| 5,974,608 | A | * | 11/1999 | Haller | A47C 27/084 5/420 |
| D419,495 | S | * | 1/2000 | Muhanna | 5/706 |
| 6,138,306 | A | * | 10/2000 | Muhanna | A61G 1/04 128/870 |
| 8,211,263 | B2 | * | 7/2012 | Kim | B29C 65/18 156/285 |
| D779,609 | S | * | 2/2017 | Osimo | D21/803 |

* cited by examiner

INFLATABLE PAD AND METHODS FOR USING THE SAME

CROSS REFERENCE TO RELATED APPLICATIONS

The present application is a continuation of U.S. patent application Ser. No. 14/860,451 filed on Nov. 9, 2015 and is entitled "INFLATABLE PAD AND METHODS FOR USING SAME" which is a continuation of U.S. patent application Ser. No. 12/942,897 filed on Nov. 9, 2010 and is entitled "INFLATABLE PAD AND METHODS FOR USING SAME" which claims the benefit of U.S. Provisional Patent Application Ser. No. 61/259,568 filed Nov. 9, 2009, entitled "INFLATABLE FRAME STRUCTURE," and U.S. Provisional Patent Application Ser. No. 61/370,405 filed Aug. 3, 2010 entitled "INFLATABLE FRAME STRUCTURE," which are both hereby incorporated herein by reference in their entirety.

BACKGROUND OF THE INVENTION

The Field of the Invention

The present invention relates to inflatable support structures.

The Relevant Technology

When camping, a lightweight pad or mattress is typically used under a sleeping bag. Camping pads provide support, padding, and some insulation for the user. Camping pads fall into two general categories: inflatable and not inflatable.

Those that are not inflatable are essentially closed-cell foam strips of a predetermined size. Non-supporting pads tend to be heavier than inflatable types. Non-supporting pads may be used in any camping situation.

There are two basic types of inflatable camping pads, both of which rely on a quantity of air for inflation during use and which deflate for portage.

A first, and generally older type of camping pad, is essentially an inflatable air mattress. A fill valve is opened and air is forced in under positive pressure by mouth, typically, to inflate the camping pad a desired amount.

A second, and generally newer type of camping pad, is a variation of the prior type that also includes an open-cell expandable type of foam filler therein. When a fill valve for such a type of camping pad is opened, the compressed foam (from the deflated state) begins to expand and naturally inflates the mattress. The camping pads that include the foam are generally regarded as being of superior design because they self-inflate (at least to a limited extent) and therefore are easier to use. Also, they tend to be warmer and therefore, more comfortable.

While these and perhaps other types of camping pads or mattresses have been used for a long time, they have certain disadvantages when used for camping. For example, virtually all campers are aware of the rarity of level, smooth ground. In addition, the ground tends to act as a heat sink that can rob the sleeper of valuable body heat, which can cause campers to be cold while sleeping on the ground.

BRIEF SUMMARY OF THE INVENTION

The present invention relates to inflatable pads and methods for using the inflatable pads to support a person lying thereon (e.g., lying supine, prone, or on one's side on the ground while camping). The inflatable pad includes an inflatable frame having a length and width that defines a pad area suitable for supporting a person lying thereon. A plurality of internal support members are configured to support the weight of a person lying thereon and elevate the person above the ground. The inflatable pad includes non-supporting regions that have less fill volume than regions that support primary support regions such as the hips and shoulder. Fill volume (i.e., the air required to fill the inflatable support members) is reduced by properly selecting the thickness and/or spacing of the support members in is selected regions of the pad. The reduced fill volume allows the pad to be filled in a more reasonable period of time and with less effort than inflatable pads that have uniform support. Moreover, in some embodiment, the inflatable pad may be inflated to pressures greater than 2 psi (i.e., greater than pressures obtained using one's lungs), which provides greater comfort and allows proper support with a much thinner and lighter pad compared to inflatable pads that have uniform cushioning across the length of the pad.

In one embodiment the inflatable pad includes a frame comprising a first sheet of material joined to a second sheet of material by a plurality of elongate bond lines, the elongate bond lines forming a plurality of fluidly coupled cells that define a plurality of air-inflatable support members, a portion of the bond lines define non-supporting regions within the pad area. A first valve is coupled to the inflatable frame and is in fluid communication with the fluidly coupled cells.

In a second embodiment, the inflatable pad includes primary support regions that have more volume per unit of pad area as compared to secondary support members. In this embodiment, the inflatable pad includes an inflatable frame having a length and width that defines a pad area suitable for supporting a person lying thereon, the frame including a plurality of fluidly coupled cells that define a plurality of air inflatable support members. The frame has a plurality of primary supported regions and a plurality of secondary supported regions. The primary supported regions have a higher pad volume per unit of pad area than the secondary supported regions. The primary support regions are located in a hip region, shoulder region, and/or head region and the secondary supported regions are located in a neck, middle back, upper leg, and/or lower leg region. The inflatable pad also includes a first valve coupled to the inflatable frame and in fluid communication with the fluidly coupled cells.

The present invention also relates to inflatable pad that have minimal torsion when inflated. The inflatable pads include bond lines that form the plurality fluidly coupled cells. The bond lines may include fabric welds in which a first portion of the bond lines have a different bond thickness than a second portion of the bond lines. The different thicknesses of the bond lines are positioned on the inflatable pad so as to reduce torsion in the frame when inflated.

The present invention is also directed to methods for inflating and supporting a person on the inflatable pad. In one embodiment, the methods can include inflating the pad to a first pressure by mouth and then inflating to a second higher pressure using a pump. This embodiment takes advantage of the large volumes, low pressure capabilities of a person's lungs, while providing a reasonably sized pump that Can create the pressures that provide comfort and proper insulation m a compact inflatable pad.

BRIEF DESCRIPTION OF THE DRAWINGS

In the drawings.

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

I. Introduction

The present invention relates to inflatable pads such as, but not limited to, sleeping pads used for camping. The placement of the support structures is designed in such a way as to minimize weight, and volume, but achieve proper support. In addition, because the inflatable pad uses air pressure to support the camper's weight, the inflatable frame structure can be made from non-rigid materials, which allows the frame to be collapsed and packed into a small volume when the frame is not inflated.

The inflatable frame structure described herein may be used to lift a person and/or camping pad or another article off of the ground. By lifting a camper's sleeping bag, camping pad, tent, or other article off the cold ground, the air trapped between the ground and the pad, tent, or person provides substantial insulation relative to the bulk and weight of the sleeping pad. Additionally, because the sleeping pad elevates the camping pad above the ground, the frame structure may provide additional protection from rocks, roots, and other objects that might otherwise cause discomfort to the sleeper.

For purposes of this invention, the term fill volume means the volume of air within the fluidly coupled support members when filled to a pressure of 2 psi.

For purposes of this invention, the term pad area means the footprint of the pad when inflated to a usable pressure (i.e., the pressure in the pad is sufficient to elevate a person off the ground). The pad area includes non-supported or non-inflated regions within the periphery of the inflated pad.

II. Sleeping Pads

Figure 1:
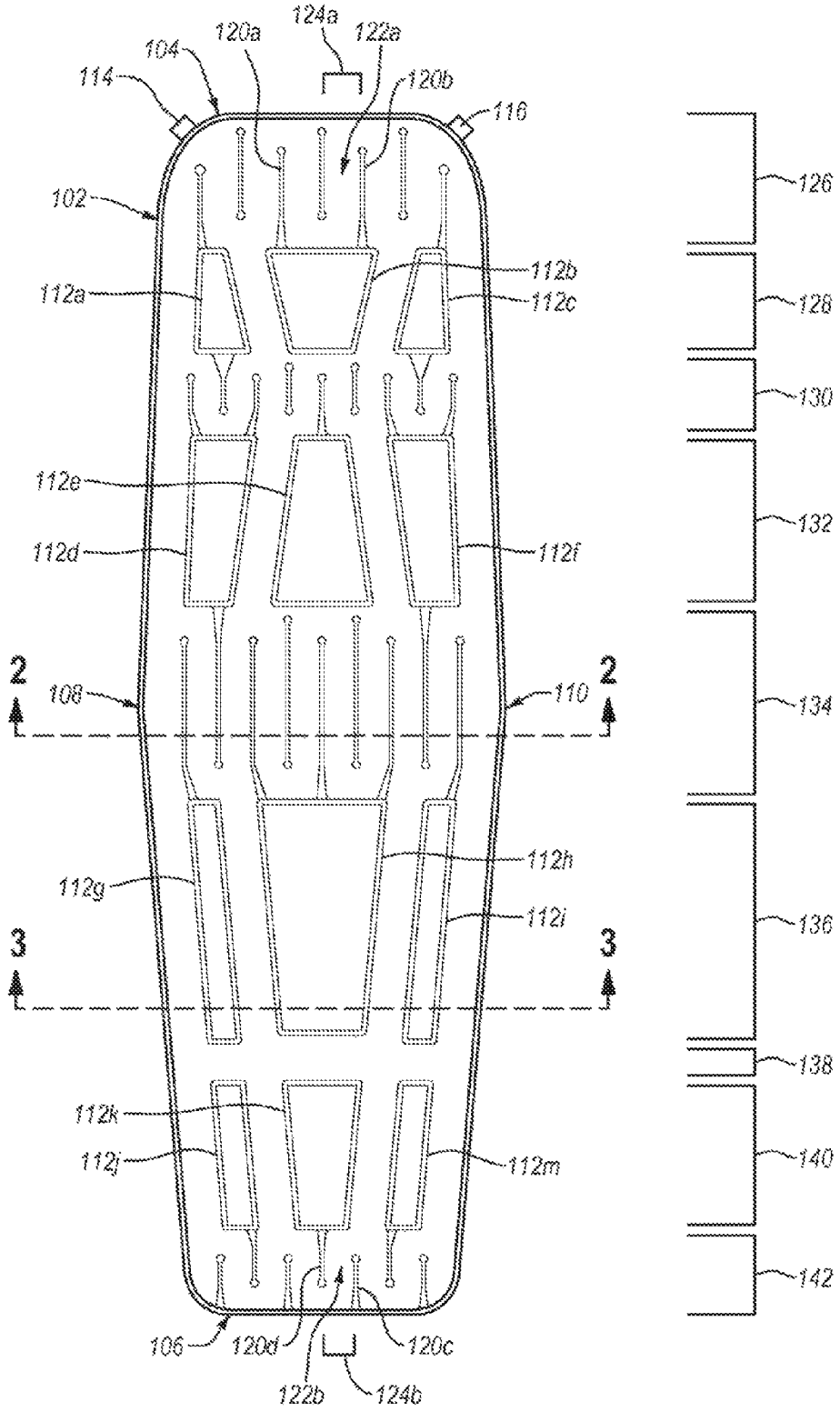
FIG. 1 illustrate an inflatable pad according to one embodiment of the invention.

FIG. 1 illustrates an example inflatable sleeping pad 100 configured for supporting a person sleeping thereon. The sleeping pad includes an inflatable frame 102 having a length and width that defines a pad area suitable for supporting a person lying thereon. The frame has a length that extends between first end 104 (i.e., head end) and second end 106 (feet end) and a width that extends between side 108 and side 110. Sleeping pad 100 also includes a first valve 114 that is mouth inflatable and a second valve 116 that connects to a pump. Valves 114 and 116 are in fluid communication with frame 102 and are configured to allow frame 102 to be inflated and deflated.

Sleeping pad 100 is formed from a first sheet of material joined to a second sheet of material by a plurality of elongate bond lines 120. For clarity, only a portion of the bond lines and fluidly coupled cells illustrated in FIGS. 1-6 are identified with numbers. In FIG. 1, bond lines 120*a* and 120*b* join first and second sheets of fabric together to form a fluid cell 122*a* that when inflated provides a support member having a width 124*a*. Similarly, bond lines 120*d* and 120*c* form fluid cell 122*b* that, when inflated, provide a support member having a width 124*b*.

In the embodiment shown in FIG. 1, a portion of the bond lines form a plurality of fluidly coupled cells that provide inflatable support members and at least a portion of the bond lines form non-supporting regions within the pad area. For example, cut outs 112*a*, 112*b*, 112*c*, 112*d*, 112*e*, 112*f*, 112*g*, 112*h*, 112*i*, 112*j*, 112*k*, and 112*m* may be non-inflatable regions that are sealed off by bond lines from valves 114 and 116 and cells 124*a* and 124*b*. In FIG. 1, the non-supporting regions 112 may have the fabric cut out to minimize weight. However, in alternative embodiments non-inflated regions 112 may include one or more layers of fabric. Moreover, non-supporting regions may be inflatable so long as the vertical thickness of the regions renders the region, non-supporting. Non-supporting regions typically have a vertical thickness less than half that of the supporting members, preferably less than one third, and most preferably less than one fourth that of the vertical thickness of the adjacent supporting members.

In one embodiment, the sheets of material joined to form the fluidly coupled cells may be a gas impermeable laminate material, such as, but not limited to, polyethylene, polypropylene, polyurethane, urethane, silicone rubber, latex rubber, polytetrafluoroethylene (PTFE), expanded PTFE, butyl rubber, and/or Mylar.

Exemplary techniques for forming bond lines with material that is joined together to form a plurality of fluidly coupled cells include, but are not limited to, ultrasonic welding, laser welding, stamp heat welding, hot plate welding, gluing, taping, sewing, one piece woven, and other fabric joining techniques known by those having skill in the art.

The sheets that form the fluidly coupled cells are gas impermeable. The material used to make the cells can be gas impermeable or can be coated or laminated to be gas impermeable. Moreover, the impermeability can be imparted before or after joining the sheets to form the cells. For example the cells may be created by ultrasonically welding a material that is gas impermeable. Alternatively a fabric can be sown or woven and then laminated to make the sheets gas impermeable. For example, sheets joined by bond lines can be formed from a one piece woven fabric that is then laminated to form a gas impermeable inflatable support structure. One piece woven technology suitable for making the inflatable pads of the invention are known in the art of making airbags.

In one embodiment the bond lines can be formed by repeating patterns of cells formed from two sheets that are welded together using an ultrasonic welding drum or a hot plate welding drum that is machined or controlled to impress the pattern into the sheets of fabric. Exemplary techniques to welding the first and seconds sheets of gas impermeable material together to form a chamber having a cell structure comprising a plurality cells that are in fluid communication include, but are not limited to, ultrasonic welding, laser welding, stamp heat welding, hot plate welding, gluing, taping, sewing, and other fabric joining techniques known by those having skill in the art.

To minimize pad fill volume and pad weight, the support structures m certain regions of the pad area can be configured to support a particular part of a person's body when lying thereon. Regions that may be included in pad 100 include head region 126, neck region 128, shoulder region 130, middle back region 132, hip region 134, upper leg region 136, knee region 138, lower leg region 140, and feet region 142. Pad 100 typically includes at least shoulder region 130, hip region 134, and middle back region 132.

The size and configuration of the support members in combination with the size and configuration of the non-supporting regions is selected to provide adequate support and insulation while reducing or minimizing pad fill volume and/or pad weight.

Figure 2:
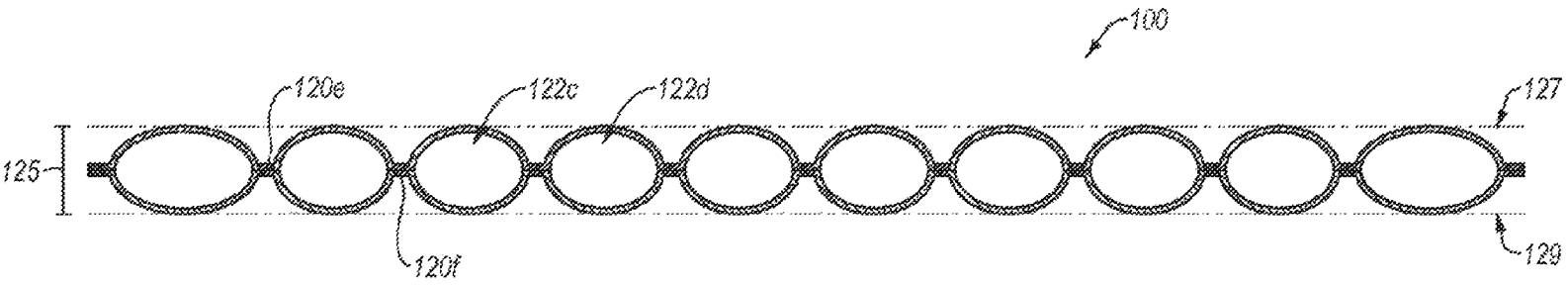
FIG. 2 is a cross section of the inflatable pad of FIG. 1 showing a primary region with high pad volume per unit pad area.
Figure 3:
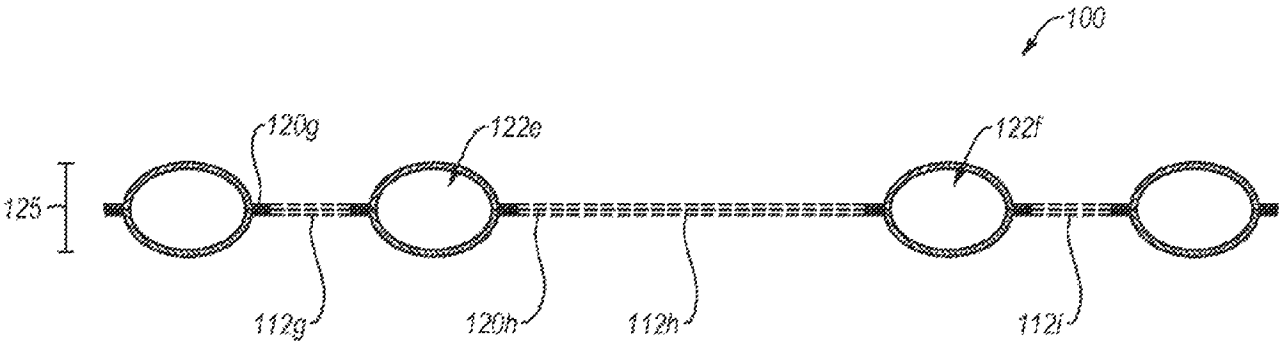
FIG. 3 is a cross section of a the inflatable pad of FIG. 2 showing a secondary region with a low pad volume per unit pad area.

FIGS. 2 and 3 illustrate cross-sections of sleeping pad 100 across different regions of sleeping pad 100. As shown in FIGS. 2 and 3, sleeping pad 100 includes fluidly coupled cells 122, bond lines 120, and non-supporting regions 112. The plurality of cells 122 provide an upper surface 127 and a lower surface 129 of inflatable pad 100 with a vertical thickness 125. The upper surface 127 provides a surface that can contact and elevate the user (e.g., by contacting the user directly or supporting another structure such as a tent floor, second camping pad, or sleeping bag). The bottom surface 129 is the surface configured to rest on the ground or sleeping surface (e.g., bunk or tent floor). In one embodiment, surface 127 can be made from a thicker or more durable fabric than upper surface 127, which avoids ruptures caused by sharp objects (e.g., rocks and sticks) that may be on the ground.

In one embodiment, the location of non-supporting regions and/or the thickness of the pad in a particular region can be selected to minimize pad fill volume while providing good support to a person's body when lying thereon. For example, in one embodiment, a secondary region including the neck region 128, middle back region 132, upper leg region 136, and/or lower leg region 140 can have fewer support members and/or a lower cell volume per unit of pad area than one or more primary regions that include head region 126, shoulder region 130, hip region 134, and/or feet region 142. The head, shoulder, hip and feet region can include adjacent support members that span between sides 108 and 110 and provide a higher density of support members than other regions.

With reference again to FIGS. 1-3, the cross-section shown in FIG. 2 is through hip region 134 and the cross section shown in FIG. 3 is through upper leg region 136. As evident from FIGS. 1-3, the fill volume per unit pad area is much greater in the hip region 134 shown in FIG. 2 compared to the fill volume per unit pad area in the upper leg region 136 shown in FIG. 3. This difference is achieved by having support structures of a similar size in both regions and including non-inflating regions 112 in the secondary region (i.e., the upper leg region).

In order to form non-supporting regions, the inflatable pad 100 may include angled support members that define triangular and/or trapezoidal non-supporting regions in the secondary (i.e., less supportive) regions. In contrast, a majority of the bond lines in the primary region may be substantially parallel. For example, a majority of the bond lines of adjacent support members in the primary regions of pad 100 are substantially parallel. In alternative embodiments, parallel bond lines may be horizontal, vertical, or non-perpendicular to the periphery of the frame of the inflatable pad.

The vertical thickness is typically selected in combination with the design pressure to achieve a desired support. Generally greater design pressure allows for a smaller vertical thickness while still elevating a person off the ground. In one embodiment, the pad is configured to be filled with greater than 2 psi, greater than 3 psi, greater than 5 psi, or even greater than 10 psi. The pressure is preferably less than 30 psi, more preferably less than 15 psi, even more preferably less than 10 psi, and most preferably less than 5 psi. The present invention also includes ranges of the foregoing pressures. Pressures above 2 psi generally require a pump since human lungs cannot typically inflate a pad sized for a person to a pressure greater than 2 psi.

The average vertical thickness of the support members of the pad is typically correlated with the lateral spacing of the bond lines, wherein wider bond lines results in an increased vertical thickness and thus increased fill volume. In one embodiment, the vertical thickness of the support members may be in a range from about 2 cm to about 10 cm, preferably 2.5 cm to about 8 cm, or more preferably 3 cm to 6 cm.

The position and size of the non-supporting or non-inflating regions is selected to reduce pad volume while maintaining proper support. The size of non-supporting regions 112 can be at least about 2 cm in length and width, at least 5 cm in length and width, or even at least 10 cm in length and width. At least a portion of the non-supporting regions may cover at least 25 $cm^2$ of the pad area, at least 50 $cm^2$, or at least 100 $cm^2$ and more preferably 200 $cm^2$.

The non-supporting regions may be spaced apart at particular distances to avoid locations where a person lying on the pad will fall through and contact the ground. In one embodiment, the non-supporting regions between support members range from about 2.5 cm to about 40 cm. In another embodiment, the distance between adjacent internal support members ranges from about 5 cm to about 30 cm. In yet another embodiment, the distance between adjacent internal support members ranges from about 10 cm to about 20 cm.

Figure 4:
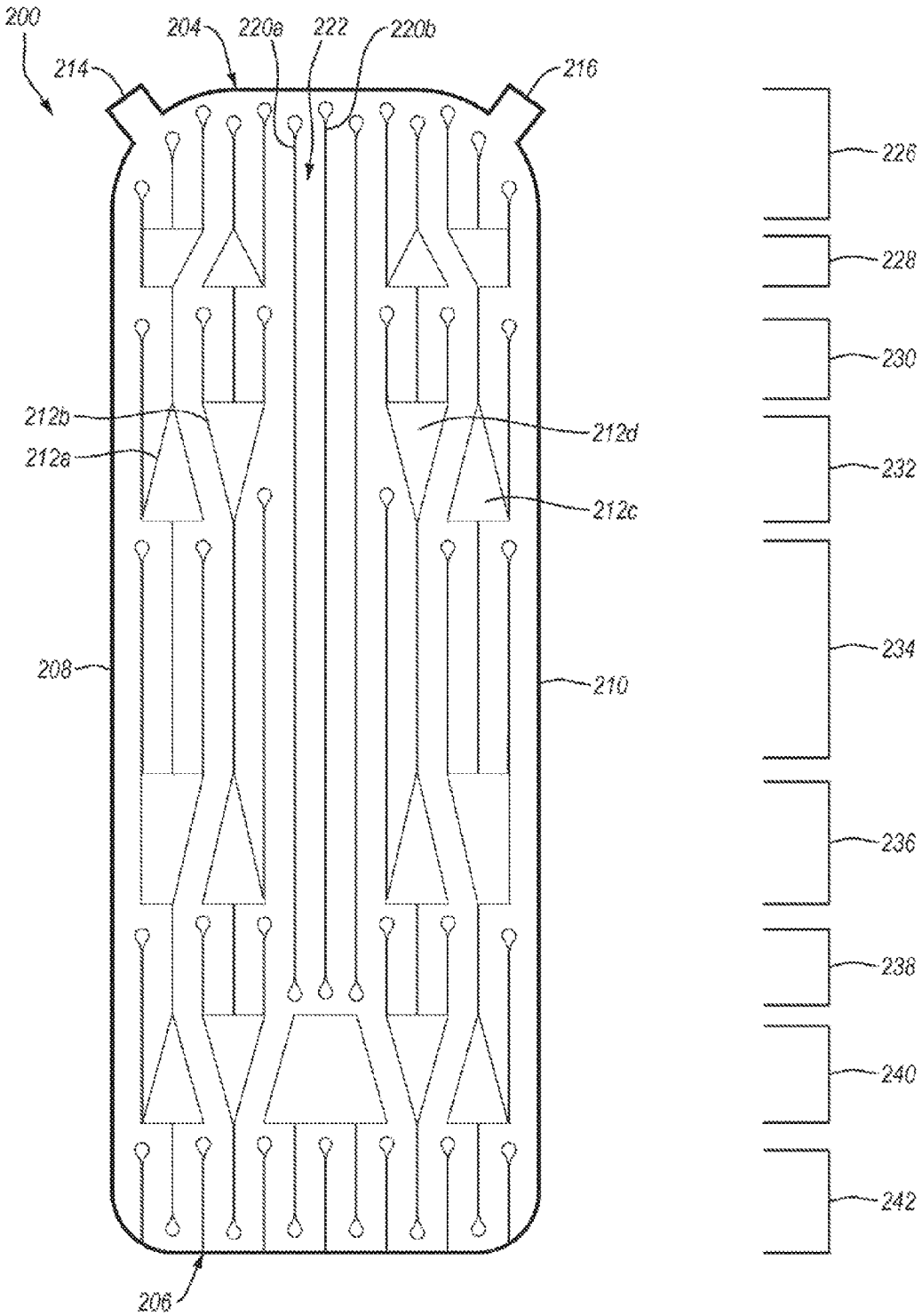
FIG. 4 illustrates an alternative embodiment of a an inflatable pad according to the present invention including substantially parallel vertical bond lines.
Figure 5:
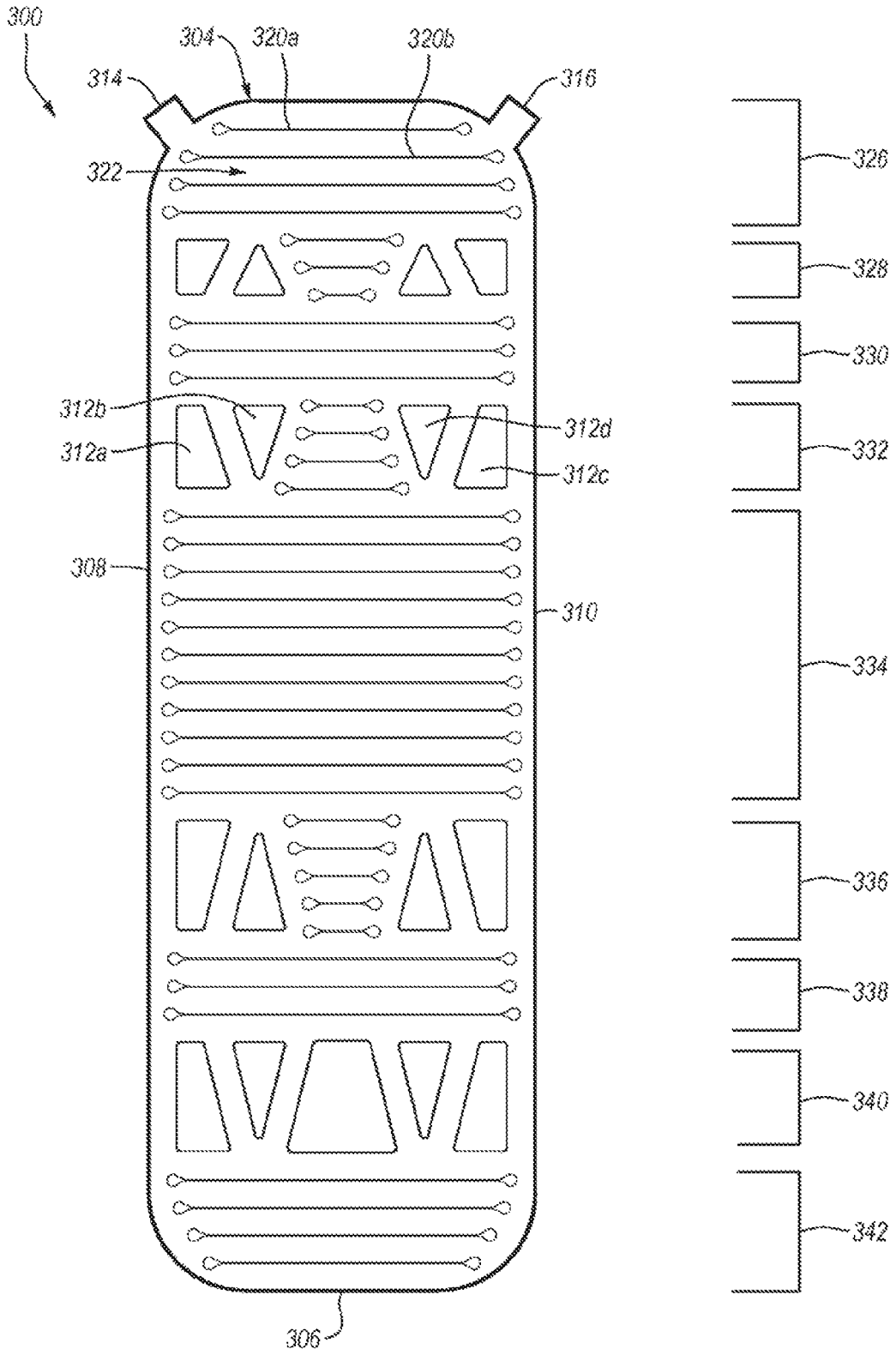
FIG. 5 illustrates an alternative embodiment of an inflatable pad according to the present invention including substantially parallel horizontal bond lines.
Figure 6:
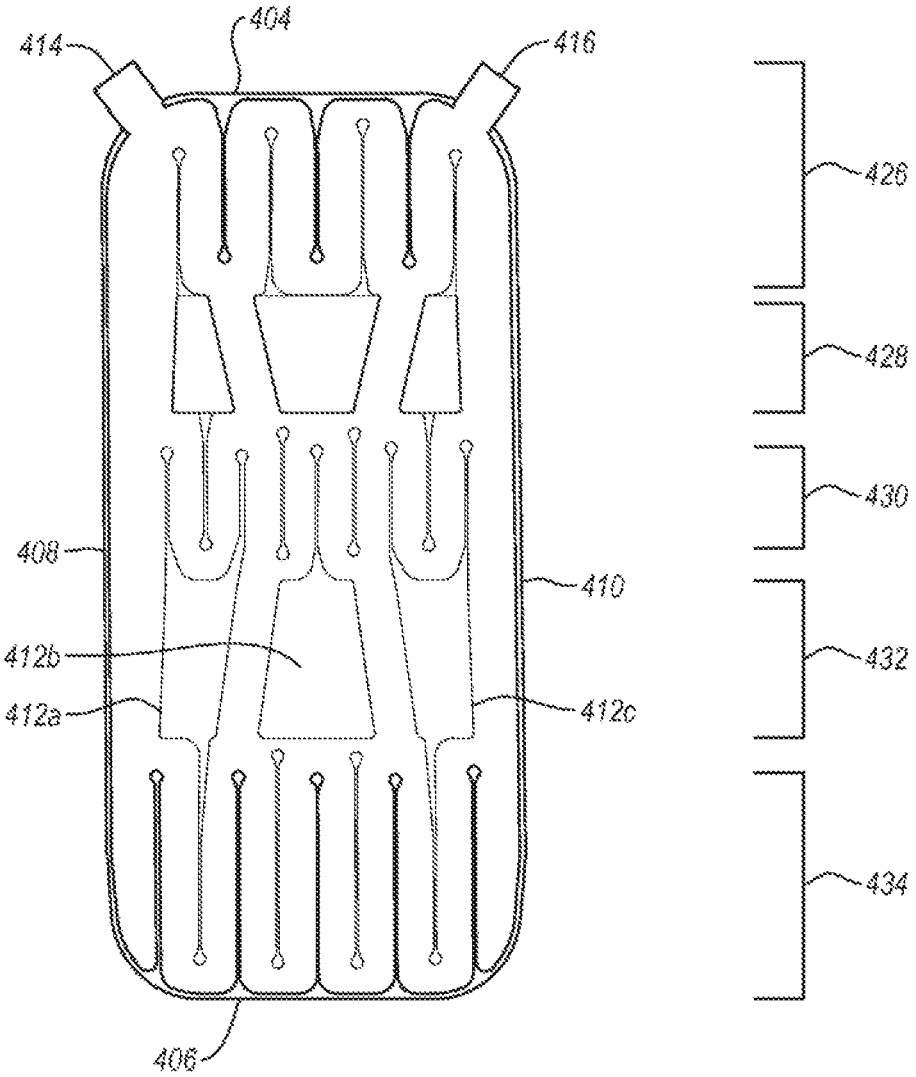
FIG. 6 illustrates yet another alternative embodiment of an inflatable pad according to the present invention.

The non-supporting regions reduce the fill volume per unit of pad area in the regions where thicker support is not necessary to provide separation from the ground, thereby reserving larger fill volumes for important regions. The larger fill volume per unit pad area in the head region 126, shoulder region 130, hip region 134, and/or feet region 142, provides better insulation and separation between the ground and portions of a person's body in places that require more insulation and/or support. Those skilled in the art will recognize that various different arrangements of non-supporting regions can be used to provide insulation and/or support in desired locations. FIGS. 4-6 illustrate alternative configurations of support members and non-supporting regions.

FIG. 4 illustrates a pad that includes non-supporting regions 212*a*-212*c* concentrated toward the sides 208 and 210 of inflatable pad 200. Inflatable pad 200 includes a head region 226, neck region 228, shoulder region 230, back region 232, hip region 234, upper leg region 236, knee region 238, lower leg region 240, and foot region 242. The support members 222 are formed from a plurality of bond lines form fluidly coupled cells. A majority of the bond lines and support members are substantially parallel to sides 208 and 210. By placing the non-supporting regions 212 on the lateral sides, the support members located centrally can extend from end 204 to lower leg region 240. Non-supporting regions 212*a*-212*c* may be triangular shaped and/or trapezoidal shaped to minimize torsion of the inflatable pad 200.

FIG. 5 illustrates an alternative embodiment in which bond lines 320 are horizontal (i.e., perpendicular to sides 308 and 310 and parallel with ends 304 and 306. Inflatable pad 300 includes a head region 326, neck region 328, shoulder region 330, back region 332, hip region 310, upper leg region 336, knee region 338, lower leg region 340, and feet region 342. Non-supporting (e.g., non-inflatable) regions 312*a*-312*d* are positioned toward lateral sides 308 and 310 and support members are positioned centrally from head region 326 to lower leg region 340. The ends of horizontal support members do not extend all the way to sides 308 and 310, which provides a channel on the inside of sides 308 and 310 where air can flow and fill or deflate horizontal support members 322.

Those skilled in the art will recognize that other configurations can be used in which the shoulders, head, and hip regions are supported more than the middle of the back, and/or legs. In some embodiments the inflatable pad need not extend the full length of a person. FIG. 6 shows a shortened pad 400 that has a first end 404 that extends to a second end 406 with a head region 426, neck region 428, shoulder region 430, back region 432, and hip region 434. In this embodiment, substantially all of the leg and feet region may be eliminated. In a preferred embodiment, pad 400 at least includes non-supporting regions (e.g., low fill volume/pad area) located in the middle back region 432 and a high fill volume/pad area located in shoulder region 430 and hip region 434. The shortened inflatable pad 400 shown in FIG. 6 can be made highly compact and transportable but provide adequate support to elevate a person off the ground while camping.

Because inflatable pads shown in FIGS. 1-6 includes non-supporting regions and/or regions with low fill volume/pad area located in positions where heat loss and/or support is of less concern, the inflatable pads of the invention can have a low fill volume for a given total pad area (i.e. footprint) while still providing adequate insulation. As mentioned, the term "pad area" is the footprint of the pad when inflated to a usable pressure. In other words, the pad area is the area bounded by the ends and sides of the pad, including non-supporting regions (e.g. regions 112*a*-112*m*), whether or not the non-supporting regions are cut out. The pad area can be in a range from about 800-5000 $in^2$, preferably 1000-3000 $in^2$, and more preferably 1200-2000 $in^2$. The pad area may have dimensions of about 150 cm to about 200 cm in length and 40 cm to 60 cm in width. The fill volume of the pad may be in a range from about 3-60 liters, preferably 4-35 liters, and more preferably 5-20 liters.

In one embodiment, the ratio of fill volume to pad area can be in a range from about 0.4-4.0 $ml/cm^2$, preferably 0.5-3.0 $ml/cm^2$, and more preferably 0.6-2.0 $ml/cm^2$. The inflatable sleeping pads of the invention can also be very lightweight, which is advantageous for hiking and other outdoor uses. In one embodiment, the sleeping pad weighs less than 750 g, preferably less than 500 g, and most preferably less than 250 g. In one embodiment, the ratio of the pad weight to pad area is less than 0.08 $g/cm^2$, preferably less than 0.06 $g/cm^2$, and most preferably less than 0.04 $g/cm^2$.

Figure 7:
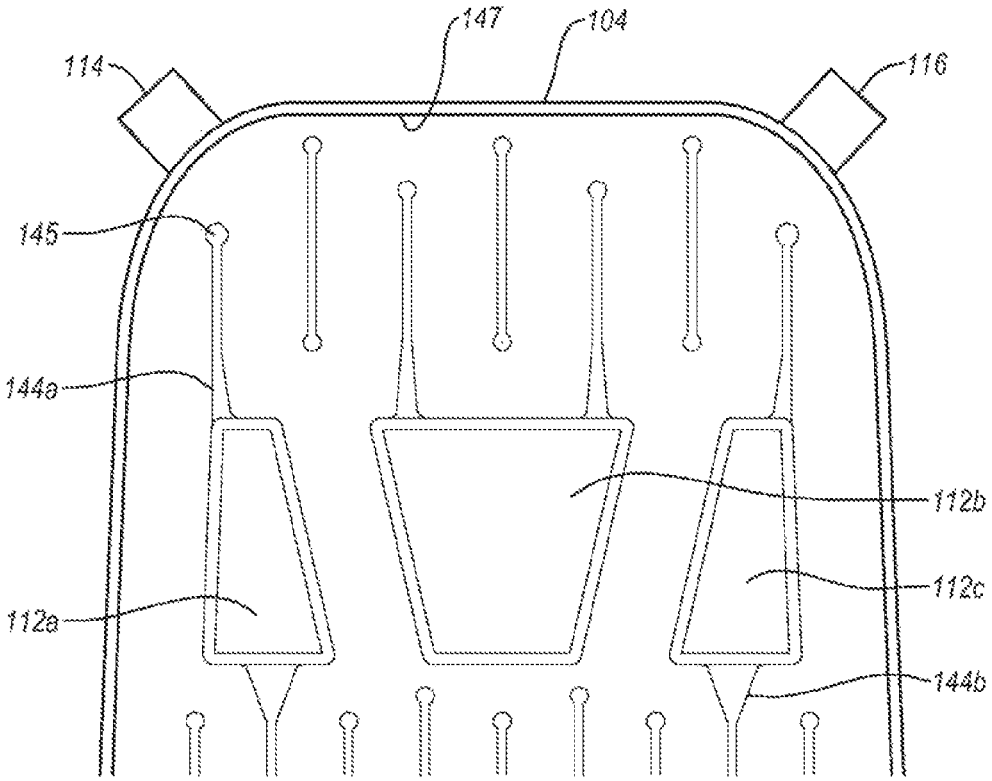
FIG. 7 is a partial top view of the inflatable pad of FIG. 1.

FIG. 7 shows a portion of the inflatable pad 100 in greater detail. In one embodiment, one or two valves are provided on an end of the inflatable pad such that the inflatable pad can be rolled up in a way that allows air to escape as the pad is uninflated. In a preferred embodiment, the inside surface 147 at an end 104 of inflatable pad 100 does not have bond lines that join the outer periphery. By terminating the bond lines before the edge or inner surface 147 between valves 147, air is allowed to travel between the two valves and can escape as the pad is rolled or folded. Moreover, by providing two valves, the pad 100 can be folded in half before rolling or folding lengthwise and air can still escape both sides of the pad. While the valves have been shown on end 104, the valves 114 and 116 can also be positioned on an opposite end 106 of pad 100 (FIG. 1). Providing a channel along the inside of the outer edge can also be beneficial on the sides of the pad. For example, as shown in FIG. 5, horizontal support members can be terminated before reaching sides 308 and 310. Bond lines that terminate in an interior of the pad area preferably include a rounded end (e.g., rounded end 145), which avoids separation of the sheets.

The valves 114 and 116 may be used to provide both mouth inflation and pump inflation. The mouth inflation and pump inflation can be provided in a single valve or two separate valves. Two separate valves that allow both mouth inflation and pump inflation can also be used. Any valve mechanisms known in the art suitable for mouth inflation and pump inflation can be used. In a preferred embodiment, a pump valve includes a connector with one or more ridges that allow a pump to be snap connected to prevent its release as pressure in the fluidly coupled cells reaches pressures exceeding 2 psi. Where two separate valves are used, the valves are preferably spaced apart on opposite sides or opposite ends of the sleeping pad such that the sleeping pad can be folded in half when deflated and still provide an outlet for fluid escaping the fluidly coupled cells.

Surprisingly, the thickness and configuration of the bond lines 120 can substantially impact the torsional stability and shape of pad 100. Torsion across pad 100 can be minimized wherein a majority and/or substantially all of the bond lines 120 forming the inflatable fluidly coupled cells 122 are substantially parallel. The number of parallel lines from one side to the other can also change the outer dimensions of the pad by pulling in the outer edges horizontal to the bond lines. Bond lines that are parallel tend to pull the edges in symmetrically, thereby minimizing torsion.

The width and shape of the bond lines have been found to influence how the fabric is pulled when inflated. In one embodiment a portion of the bond lines 120 can flare. Or in other words, the bond width can increase towards one end, which has been found to bunch the fabric lateral to the flared end. For example, a portion of the bond lines in FIG. 7 include flares 144*a* of medium width and flares 144*b* with greater flaring.

A second end 145 of a portion or all of the bond lines may have a rounded end. Since end 145 is a termination point of the bonding, the end may be rounded to add additional bonding strength and to distribute pull forces in a radial manner, which tends to minimize the chances of the first and second sheets pulling apart at this location. The other bond lines (not numbered) in FIG. 7 may include similar features of rounded and flared ends. In an alternative embodiment an inflatable pad may have a first portion of parallel bond lines having a different bond thickness than a second portion of the parallel bond lines. In a preferred embodiment, the different bond line thicknesses reduce torsion in the frame when inflated.

The minimum and/or average width of the bond lines can be in a range from 1 mm to 20 mm, preferably 2 mm to 15 mm, and more preferably 3 mm to 10 mm. The flare preferably occurs over a length of at least 5 mm and the increase in width along the flare can be at least 1 mm, preferably at least 2 mm and most preferably at least 5 mm.

The rounded ends can have a diameter in a range between 10-30 mm preferably 12.5-25 mm, and most preferably 15-20 mm.

III. Methods of Using a Sleeping Pad

In another embodiment, a method for elevating an article above the ground is disclosed. In one aspect, the method may include (1) providing an inflatable support structure sized and configured for elevating the article above the ground, and (2) inflating the inflatable support structure to a pressure in a range from about 2 psi to about 20 psi so as to elevate the article above the ground. In one embodiment, the inflatable support structure includes at least first and second layers of a gas impermeable material joined together to form a plurality of fluidly coupled cells, wherein the plurality of fluidly coupled cells include a peripheral support frame and a plurality of internal support members disposed within the peripheral frame, and a valve mechanism fluidly coupled to the plurality of inflatable cells and configured for inflating and deflating the inflatable support structure.

In one embodiment, the inflatable pad may be inflated to a first pressure using mouth inflation and then inflated to a second pressure using a pump. The pump may be used to inflate the pad to a pressure in a range from 2 psi to 20 psi, preferably 3 psi to 10 psi in order to support the weight of a sleeper. The sleeping pad can then be used by a person to sleep by lying on the pad and being elevated above the ground by the inflatable pad.

The pump used to inflate the pad to a second pressure above 2 psi may be a hand pump, a bicycle pump, or a compressed gas inflation device. Suitable examples of compressed gases that can be used to fill the inflatable frame structure may include, but are not limited to, air, argon, krypton, xenon, carbon dioxide, sulfur hexafluoride, and combinations thereof. For example, a user who inflates by mouth followed by "topping off" with a compressed gas inflation system that uses an 8 gram (21 ml at 3600 psi) canister of argon can get 4-5 "top offs" with 1 canister or one complete fill with one canister.

In one embodiment, the methods include inflating the frame, supporting a sleeping pad and/or sleeping pad with a person thereon or therein. In this embodiment, the pressure and thickness in the frame may be configured to support the person lying on the sleeping pad such that there is substantially no direct contact between a flat support surface and the sleeping pad. In one embodiment, the person can be an adult male with a height in a range from about 5 feet 6 inches to 6 feet 4 inches and weighing in a range from about 120 pounds to about 230 pounds. In an alternative embodiment, the frame can be configured for a person weighing between 80 and 160 pounds and a height of between 5 feet and 6 feet tall.

The present invention also includes kits of an inflatable pad according to the invention and a pump that connects to a valve of the inflatable pad to pump to a pressure greater than 2 psi.

While the present invention has been illustrated with support members that are substantially parallel, those skilled in the art will recognize that other configurations of support members can be used, including substantially round members, and substantially spherical members.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. An inflatable pad comprising:

a frame comprising: a first sheet of material and a second sheet of material joined at a plurality of bond lines, wherein the bond lines are elongated, wherein at least one end of each of the bond lines increases in width;

a plurality of fluidly coupled cells defined between at least two bond lines of the plurality of bond lines, wherein the plurality of fluidly coupled cells comprise a first width and a second width; and a first valve coupled to the frame and in fluid communication with the plurality of fluidly coupled cells.

2. The inflatable pad of claim 1, wherein the first width and the second width are the same.

3. The inflatable pad of claim 1, wherein the first width and the second width are the different.

4. The inflatable pad of claim 1, wherein the elongated bond lines are longer than they are wider.

5. The inflatable pad of claim 1, further comprising a primary region and a secondary region, wherein the primary region comprises a greater number of fluidly coupled cells than the secondary region.

6. The inflatable pad of claim 5, wherein the primary region is configured to support at least a head of a user.

7. The inflatable pad of claim 1, wherein an average vertical thickness of the plurality of fluidly coupled cells is in a range from 2.5 cm to 10 cm.

8. An inflatable pad comprising:

a pad area;

a first valve coupled to a frame and in fluid communication with the plurality of fluidly coupled cells;

the frame comprising a first sheet of fabric material and a second sheet of fabric material joined at a plurality of bond lines with at least one bond line around the entire periphery of the first sheet of fabric material and the second sheet of fabric material, wherein at least one end of each of the plurality of bond lines increases in width;

wherein the plurality of bond lines comprise non-supporting regions wherein the non-supporting regions cover at least 25 $cm^2$ of the pad area.

9. The inflatable pad of claim 8, wherein a portion of the plurality of bond lines are non-perpendicular to the periphery of the frame.

10. The inflatable pad of claim 8, wherein the bond lines are elongated and the bond lines are longer than they are wider.

11. The inflatable pad of claim 8, wherein the plurality of fluidly coupled cells comprise a first width and a second width wherein the first width is the same as the second width.

12. The inflatable pad of claim 8, wherein the plurality of fluidly coupled cells comprise a first width and a second width wherein the first width is different from the second width.

13. The inflatable pad of claim 8, wherein the frame has a maximum width in a range from 40 cm to 60 cm and a maximum length in a range from 150 cm to 200 cm with a fill volume/pad area in a range from about 0.4-4.0 $ml/cm^2$.

14. The inflatable pad of claim 8, wherein an average vertical thickness of the plurality of fluidly coupled cells is in a range from 2.5 cm to 10 cm.

15. An inflatable sleeping pad comprising:

a frame configured to hold air and configured to support a person sleeping thereon, the frame comprising:

a first sheet of material and a second sheet of material joined at their periphery by an outer bond line;

a plurality of bond lines within the periphery of the outer bond line wherein at least one end of each of the plurality of bond lines within the periphery increases in width;

a plurality of fluidly coupled cells defined between at least two bond lines of the plurality of bond lines; and a first valve coupled to the frame and in fluid communication with the plurality of fluidly coupled cells.

16. The inflatable sleeping pad of claim 15, wherein a portion of the plurality of bond lines are in communication with the outer bond line.

17. The inflatable sleeping pad of claim 15, wherein a portion of the plurality of bond lines are separate from and not in communication with the outer bond line.

18. The inflatable pad of claim 15, wherein the plurality of bond lines are elongated and flare toward a second end of the plurality of bond lines.

19. The inflatable pad of claim 15, wherein the plurality of fluidly coupled cells comprise a first width and a second width wherein the first width is the same as the second width.

20. The inflatable pad of claim 15, wherein the plurality of fluidly coupled cells comprise a first width and a second width wherein the first width is different from the second width.

* * * * *